US006953322B2

(12) United States Patent
Lim

(10) Patent No.: US 6,953,322 B2
(45) Date of Patent: Oct. 11, 2005

(54) TOWER FAN ASSEMBLY

(75) Inventor: Gary M. Lim, Palos Verdes Estates, CA (US)

(73) Assignee: Seville Classics, Inc, Torrance, CA (US)

( * ) Notice: Subject to any disclaimer, the term of this patent is extended or adjusted under 35 U.S.C. 154(b) by 83 days.

(21) Appl. No.: 10/727,748

(22) Filed: Dec. 3, 2003

(65) Prior Publication Data

US 2005/0123402 A1 Jun. 9, 2005

(51) Int. Cl.[7] ..... F04D 25/10
(52) U.S. Cl. ..... 416/100; 415/127; 415/211.2
(58) Field of Search ..... 384/609, 614; 248/349.1, 131; 415/127, 211.2; 416/79, 82, 98, 112, 116, 244 R, 100

(56) References Cited

U.S. PATENT DOCUMENTS

| | | | | | |
|---|---|---|---|---|---|
| 732,341 | A | * | 6/1903 | Devine | 416/100 |
| 963,849 | A | * | 7/1910 | Barker | 416/100 |
| 1,073,617 | A | * | 9/1913 | Motter et al. | 416/100 |
| 1,334,958 | A | * | 3/1920 | McEwen | 248/349.1 |
| 4,469,084 | A | | 9/1984 | Gillotti | |
| 4,486,144 | A | * | 12/1984 | Hung | 416/100 |
| 4,713,146 | A | | 12/1987 | Ek | |
| RE34,334 | E | | 8/1993 | Chaney | |
| 5,266,004 | A | | 11/1993 | Tsumurai et al. | 416/100 |
| 5,435,817 | A | | 7/1995 | Davis et al. | |
| 5,601,400 | A | | 2/1997 | Kondo et al. | |
| 5,984,991 | A | | 11/1999 | Glucksman | |
| 6,156,085 | A | | 12/2000 | Chiu et al. | |
| 6,344,065 | B1 | | 2/2002 | Boulva | |
| 6,406,258 | B1 | | 6/2002 | Lin et al. | |
| 6,491,502 | B2 | | 12/2002 | Hunt | |
| 2003/0021682 | A1 | | 1/2003 | Tseng | |

* cited by examiner

*Primary Examiner*—Edward K. Look
*Assistant Examiner*—Richard A. Edgar
(74) *Attorney, Agent, or Firm*—Raymond Sun

(57) ABSTRACT

A fan assembly has a base portion that remains stationary during the operation of the fan assembly, the base portion having a stationary base support plate. The assembly also includes a blower portion that includes an oscillating top plate, a blower that is coupled to the top plate and which oscillates when the top plate oscillates, and a grill cover that is coupled to the base support plate so that the grill cover remains stationary even when the top plate and the blower oscillates. The assembly can optionally include a smooth glide mechanism positioned between the top plate and the base support plate.

10 Claims, 5 Drawing Sheets

86
98
88
16
52
56

10
14
96
54
50
66
58
62
64
60
26
40
22
24
12
20

51
50
66
76
58
80
64
65
68
80
78
62
61
63
60
82
26
42

50
66
58
72
70
84
92
69
64
61
62
65
78
63
26

TOWER FAN ASSEMBLY

BACKGROUND OF THE INVENTION

1. Field Of The Invention

The present invention relates to a fan assembly, and in particular, to a tower fan assembly where the blower oscillates while the outer housing remains stationary. The tower fan assembly can also include a smooth glide mechanism which promotes smoother oscillation of the blower, and provides improved stability and balance to the oscillating blower.

2. Description of the Related Art

Numerous conventional fan assemblies are readily available in the marketplace. Tower fan assemblies are particularly desirable because of their ability to quickly circulate a large amount of air in a small area. Most conventional tower fans have an outer housing that oscillates together with the blower. Unfortunately, an oscillating outer housing can pose safety concerns, especially to children and pets.

Another drawback that is frequently experienced by conventional tower fan assemblies is that the oscillating blower and outer housing wobbles because almost the entire fan assembly sits on a single shaft which functions to oscillate the blower and outer housing. A wobbling fan assembly is not stable.

Thus, there still remains a need for a tower fan assembly that overcomes the above drawbacks.

SUMMARY OF THE INVENTION

It is an objective of the present invention to provide a tower fan assembly where the outer housing is stationary.

It is another objective of the present invention to provide a tower fan assembly which provides improved stability during operation and use.

It is yet another objective of the present invention to provide a smooth glide mechanism for the blower in a tower fan assembly.

The objectives of the present invention can be accomplished by providing a fan assembly that has a base portion that remains stationary during the operation of the fan assembly, the base portion having a stationary base support plate. The assembly also includes a blower portion that includes an oscillating top plate, a blower that is coupled to the top plate and which oscillates when the top plate oscillates, and a grill cover that is coupled to the base support plate so that the grill cover remains stationary even when the top plate and the blower oscillates. The assembly can optionally include a smooth glide mechanism positioned between the top plate and the base support plate for supporting the oscillation of the top plate about the base support plate.

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

FIGS. 1–5 illustrate one embodiment of a tower fan assembly 10 according to the present invention. The tower fan assembly 10 has a base portion 12, a blower portion 14 and a control portion 16.

Figure 2:
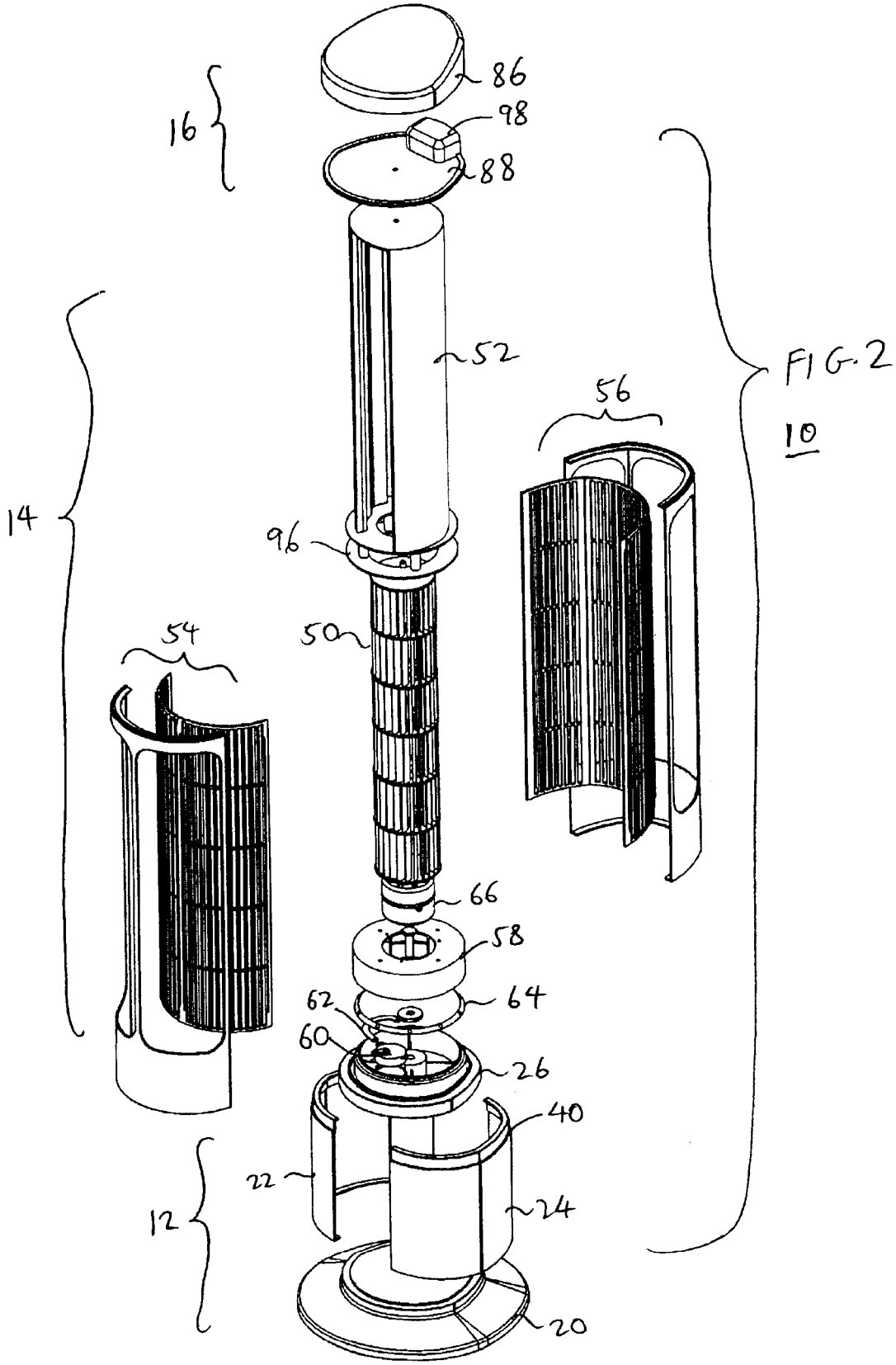
FIG. 2 is an exploded perspective view of the assembly of FIG. 1.
Figure 5:
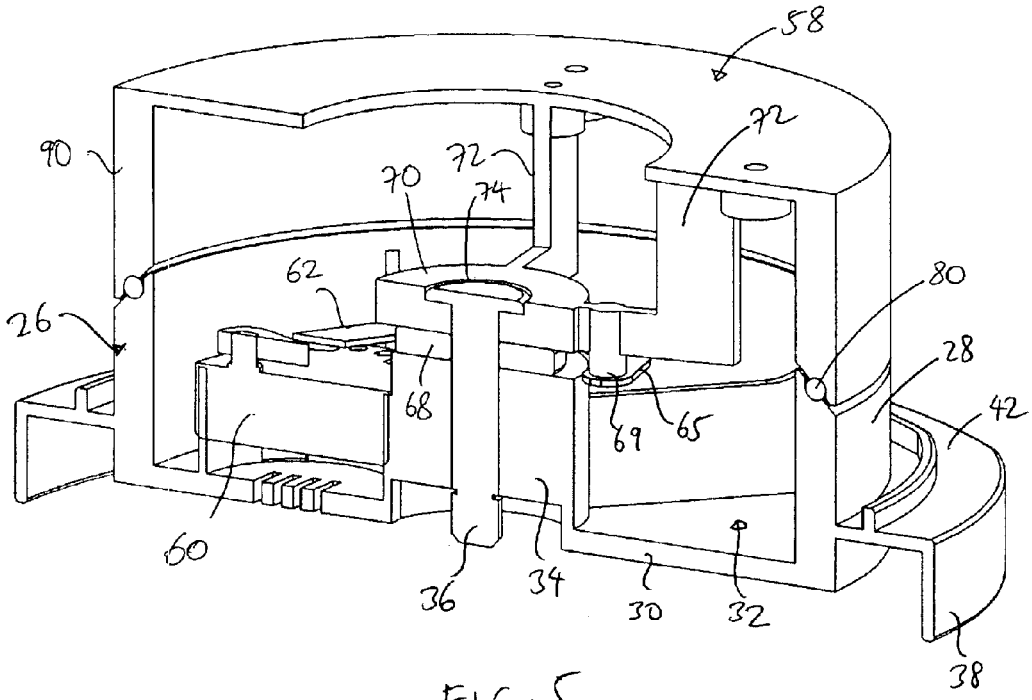
FIG. 5 is a cross-sectional view of the components in FIG. 3.

Referring to FIGS. 2 and 5, the base portion 12 is stationary, and has a base plate 20, a base support that is made up of a left shell 22 and a right shell 24, and a fixed and stationary base support plate 26. The base support plate 26 has an annular wall 28 extending upwardly from a bottom wall 30 to define an accommodation space 32 that houses the components of the oscillation assembly for the blower (described below). A central mount 34 extends upwardly from the bottom wall 30 at the center of the accommodation space 32. A bore extends through the mount 34, and a mounting shaft 36 extends the bore. An annular flange 38 extends from the annular wall 28, with the flange 38 adapted to be seated on the shoulder 40 of the shells 22 and 24. The flange 38 itself defines an annular shoulder 42.

Figure 1:
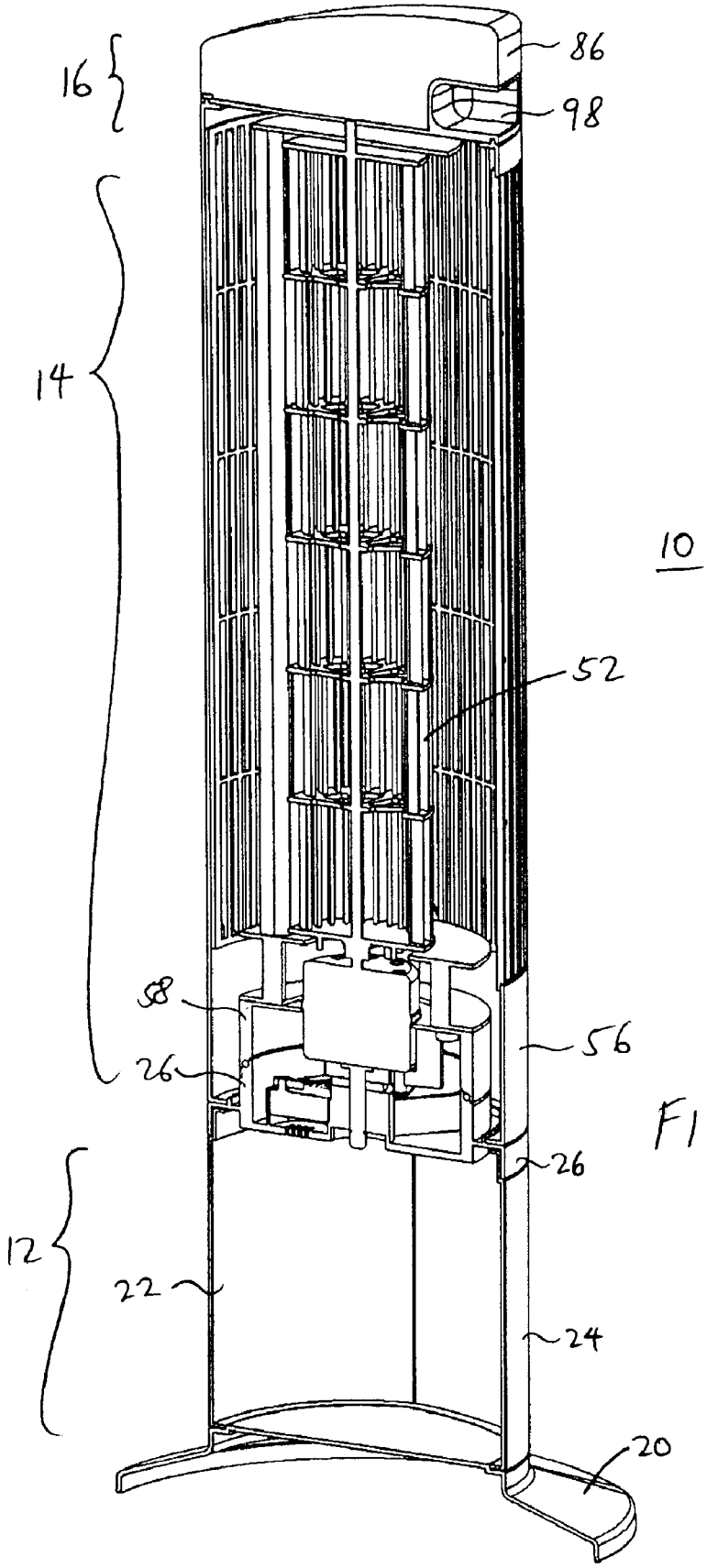
FIG. 1 is a cross-sectional perspective view of a tower fan assembly according to one embodiment of the present invention.

Referring to FIGS. 2–5, the blower portion 14 includes a blower 50, a blower housing 52, a grill cover that includes two separate grill shells 54 and 56, and an oscillation assembly. The blower 50 has a plurality of blades 51, and is driven by a blower motor 66. The blower 50 is retained inside the blower housing 52, which is in turn retained inside the grill shells 54 and 56. A base ring 96 is provided at the bottom of the blower housing 52. The bottom edges of the grill shells 54, 56 are adapted to be supported on the shoulder 42 of the base support plate 26, as best shown in FIG. 1. For example, the bottom edges of the grill shells 54, 56 can be fixedly secured to the base support plate 26 by screws or other similar attachment mechanisms.

Figure 3:
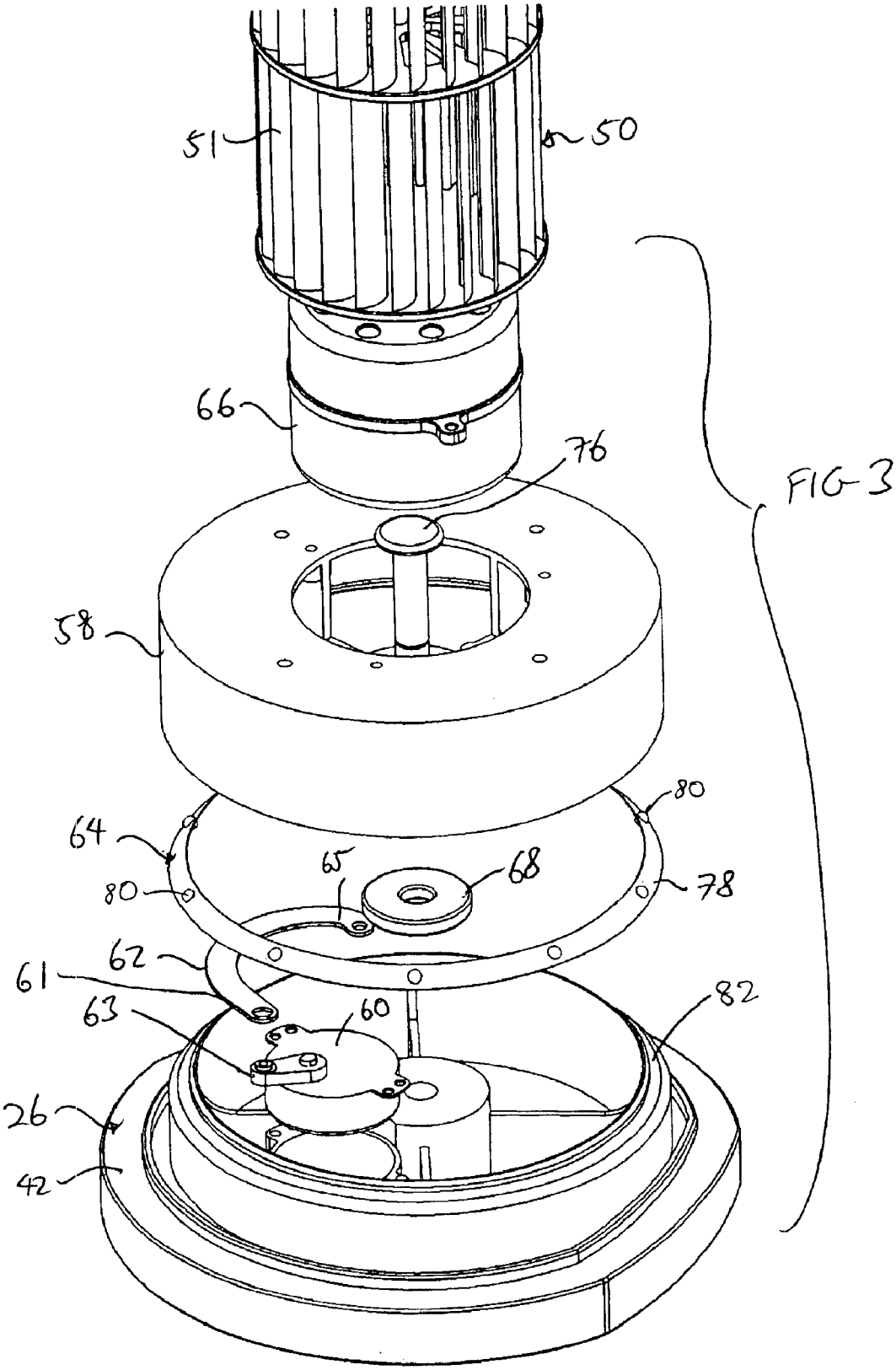
FIG. 3 is an enlarged, exploded top perspective view of certain components of the assembly of FIG.1.
Figure 4:
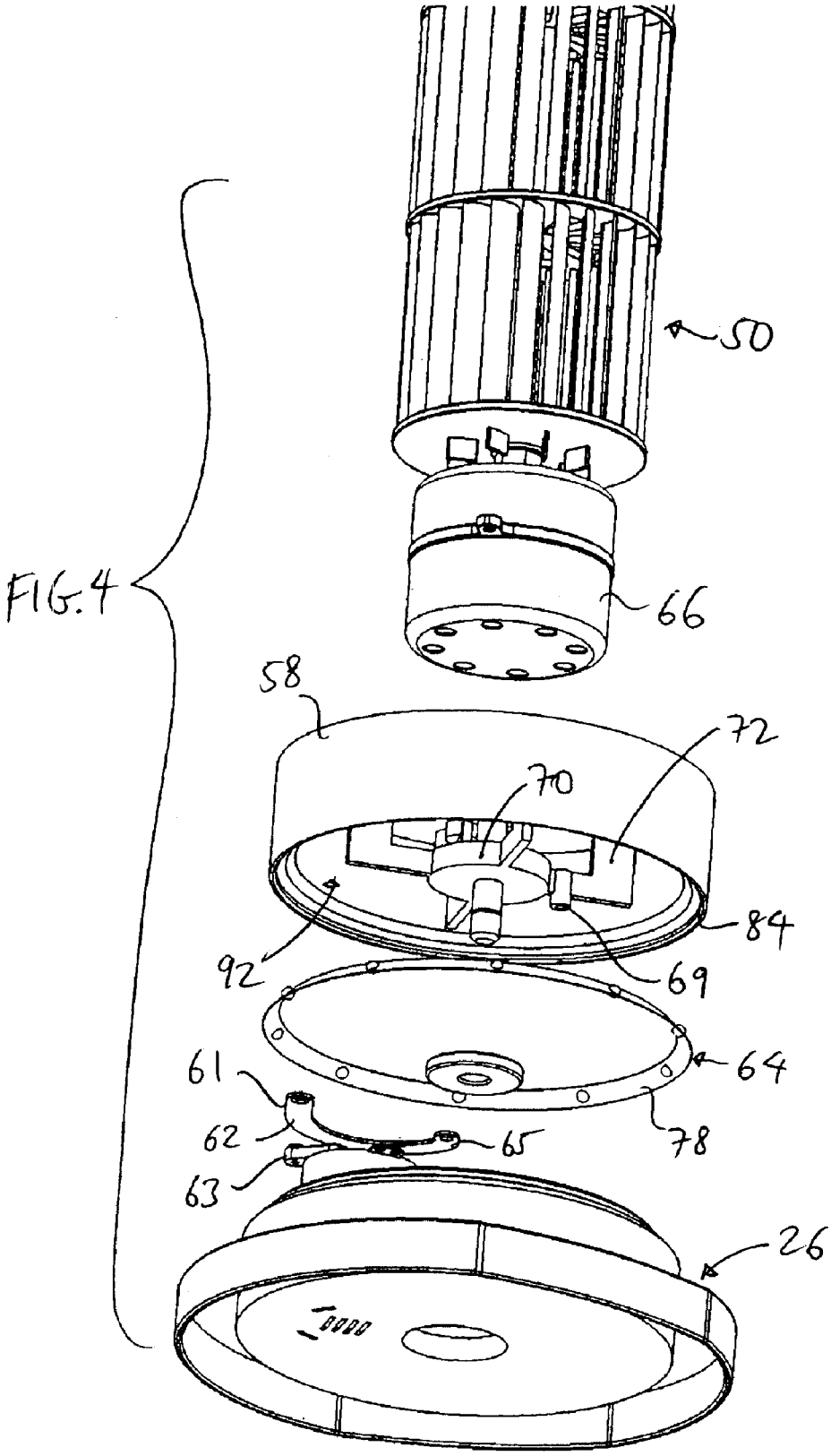
FIG. 4 is an enlarged, exploded bottom perspective view of the components in FIG. 3.

The oscillation assembly is also retained inside the grill shells 54 and 56, and includes an oscillating top plate 58 on which the base ring 96 of the blower housing 52 is mounted, an oscillation motor 60 that is secured to the bottom wall 30 inside the accommodation space 32, and an oscillating arm link 62 having one end 61 coupled to a crank 63 of the motor 60 and another end 65 coupled to a pivot pin 69 that extends from an arm 72 adjacent a support piece 70 (see FIGS. 3–5). The oscillating top plate 58 has an annular wall 90 that defines an internal space 92. A spacer grease bushing 68 can be positioned between the top of the mount 34 and a support piece 70 that is suspended from the top plate 58 by four arms 72. The support piece 70 and its four arms 72 are retained inside the internal space 92. The support piece 70 has a bore through which the mounting shaft 36 extends, and has a depression 74 at its top surface for receiving the enlarged top end 76 of the mounting shaft 36. The spacer grease bushing 68 also has an opening through which the mounting shaft 36 extends. Thus, the mounting shaft 36 is retained by the support piece 70 and extends through the spacer grease bushing 68 and the mount 34 of the base support plate 26 to function as a oscillation axis for the oscillating top plate 58 to oscillate about the fixed base support plate 26. In addition, the blower motor 66 can be secured (e.g., by screws) to the top plate 58.

The oscillation assembly can optionally include a smooth glide mechanism 64 which facilitates smoother oscillation of the oscillating top plate 58 with respect to the fixed base support plate 26. The smooth glide mechanism 64 can be embodied in the form of a retainer ring 78 that retains a plurality of spaced apart ball bearings 80. An annular ball bearing track 82 is provided along the top edge of the annular wall 28 of the fixed base support plate 26, and a corresponding annular ball bearing track 84 is provided along the bottom edge of the annular wall 90 of the oscillating top plate 58, with the bearings 80 seated between the tracks 82 and 84. Thus, the bearings 80 help to improve the sliding oscillation movement of the annular wall 90 of the oscillating top plate 58 as it oscillates with respect to the fixed annular wall 28 of the base support plate 26.

The control portion 16 includes a control panel 86 secured to a control panel base plate 88. The control panel 86 includes the switches and other control buttons for operating the tower fan assembly 10. The control panel base plate 88 is mounted on the top of the shells 54 and 56 by screws or similar attachment mechanisms. The hollowed handle 98 can be formed on the control panel base plate 88 to allow a user to insert his or her fingers inside the hollowed space for gripping the assembly 10.

In operation, the user turns on the motor 60, which will cause the crank 63 to rotate. Since the crank 63 is coupled to the link arm 62, rotation of the crank 63 will cause the link arm 62 to oscillate in a reciprocating back and forth motion. Since the arm link 62 is also coupled to the top plate 60 (via the pin 69 and an arm 72), oscillation of the arm link 62 will cause the top plate 58 to oscillate about the axis defined by the mounting shaft 36. Since the blower 50 is coupled (via the blower housing 52) to the top plate 58, the oscillation of the top plate 58 will likewise cause the blower 50 to oscillate as it blows out air. However, since the grill shells 54 and 56 are connected to the fixed base support plate 26 (via the shoulder 42), the grill shells 54 and 56 do not oscillate and remain stationary at all times.

Thus, the tower fan assembly 10 of the present invention provides a grill cover (i.e., shells 54, 56) that acts as an outer housing that remains stationary at all times even while the blower 50 housed therein is being oscillated. In addition, the smooth glide mechanism 64 allows the top plate 58 to be oscillated about the fixed base support plate 26 in a smooth manner which reduces friction, and wear and tear, thereby increasing the life and effectiveness of the oscillating blower 50. Also, the smooth glide mechanism 64 improves the balance and stability of the oscillating top plate 58 and the blower 50 because the oscillating top plate 50 and blower 50 are now supported (via the smooth glide mechanism 64) on the stationary base support plate 26, instead of being supported on a single shaft.

While the description above refers to particular embodiments of the present invention, it will be understood that many modifications may be made without departing from the spirit thereof.

What is claimed is:

1. A fan assembly, comprising:

a base portion that remains stationary during the operation of the fan assembly, the base portion having a stationary base support plate; and a blower portion that includes:

(i) an oscillating top plate that is operably coupled to the stationary base support plate, (ii) a blower that is coupled to the top plate and which oscillates when the top plate oscillates, and (iii) a grill cover that is coupled to the base support plate in a manner such that the grill cover remains stationary even when the top plate and the blower oscillates.

2. The assembly of claim 1, further including a smooth glide mechanism positioned between the top plate and the base support plate.

3. The assembly of claim 2, wherein the smooth glide mechanism includes a plurality of bearings.

4. The assembly of claim 3, wherein the top plate has an first annular ball bearing track, and the base support plate has a second annular ball bearing track, with the bearings seated between the first and second tracks.

5. The assembly of claim 3, wherein the bearings are spaced apart along a retainer ring.

6. The assembly of claim 1, further including:

a motor coupled to the fixed base support plate, the motor having a crank; and an arm link having one end coupled to the crank of the motor and another end coupled to the top plate.

7. The assembly of claim 6, wherein the top plate and the base support plate define an accomodation space therebetween, with the motor and the arm link housed inside the accomodation space.

8. The assembly of claim 1, further including a shaft that is coupled to the top plate and the base support plate, and which defines an oscillation axis.

9. The assembly of claim 1, further including a control panel coupled to the blower portion.

10. The assembly of claim 1 further including a bushing positioned between the top plate and the base support plate.

* * * * *